US009925101B2

(12) United States Patent
Kuenzler

(10) Patent No.: US 9,925,101 B2
(45) Date of Patent: Mar. 27, 2018

(54) BALANCE BED

(71) Applicant: INNO-MOTION AG, Zurich (CH)

(72) Inventor: Patrik Kuenzler, Zurich (CH)

(73) Assignee: LIMBIC LIFE AG, Zurich (CH)

( * ) Notice: Subject to any disclaimer, the term of this patent is extended or adjusted under 35 U.S.C. 154(b) by 670 days.

(21) Appl. No.: 14/383,830

(22) PCT Filed: Feb. 21, 2013

(86) PCT No.: PCT/EP2013/053439
§ 371 (c)(1),
(2) Date: Sep. 8, 2014

(87) PCT Pub. No.: WO2013/131753
PCT Pub. Date: Sep. 12, 2013

(65) Prior Publication Data

US 2015/0305954 A1 Oct. 29, 2015

(30) Foreign Application Priority Data

Mar. 8, 2012 (EP) ..... 12001607

(51) Int. Cl.
*A47C 20/04* (2006.01)
*A47C 7/02* (2006.01)
(Continued)

(52) U.S. Cl.
CPC ..... *A61G 7/015* (2013.01); *A47C 7/024* (2013.01); *A47C 7/503* (2013.01); *A47C 9/002* (2013.01);
(Continued)

(58) Field of Classification Search
CPC ..... A63B 21/00058; A63B 21/00069; A63B 21/00072; A63B 21/00076;
(Continued)

(56) References Cited

U.S. PATENT DOCUMENTS 2,577,177 A * 12/1951 Anderson ..... A61G 13/00 5/600
3,036,830 A * 5/1962 Hotas ..... A61H 1/00 482/142
(Continued)

FOREIGN PATENT DOCUMENTS

DE 102007024505 12/2008
EP 0058411 8/1982
(Continued)

OTHER PUBLICATIONS

International Search Report and Written Opinion of the International Searching Authority, for PCT/EP2013/053439, dated May 27, 2013.
(Continued)

*Primary Examiner* — Loan H Thanh
*Assistant Examiner* — Gary D Urbiel Goldner
(74) *Attorney, Agent, or Firm* — Bryan D. Zerhusen; Locke Lord LLP

(57) ABSTRACT

The invention relates to a recliner device for supporting a lying person, the recliner device having a foot and arranged thereon (i) a first movably mounted thigh support for supporting the first thigh of the person, (ii) a movably mounted second thigh support for supporting the second thigh of the person, the second thigh support being independent of the first thigh support and being combinable with the first thigh support to form a complete support, and (iii) a movably mounted back and head support that is independent of the first and second thigh supports.

25 Claims, 8 Drawing Sheets

(51) Int. Cl.

| | |
|---|---|
| ***A47C 7/50*** | (2006.01) |
| ***A47C 9/00*** | (2006.01) |
| ***A61G 7/005*** | (2006.01) |
| ***A61G 7/008*** | (2006.01) |
| ***A61G 7/015*** | (2006.01) |
| ***A61G 7/10*** | (2006.01) |
| ***A61G 7/16*** | (2006.01) |

(52) U.S. Cl.
CPC ..... *A47C 20/04* (2013.01); *A61G 7/005* (2013.01); *A61G 7/008* (2013.01); *A61G 7/10* (2013.01); *A61G 7/16* (2013.01)

(58) Field of Classification Search
CPC ..... A63B 21/000178; A63B 21/00181; A63B 21/00185; A63B 21/00189; A63B 21/002; A63B 21/0023; A63B 21/02; A63B 21/026; A63B 21/04; A63B 21/0407; A63B 21/0414; A63B 21/0421; A63B 21/0428; A63B 21/0435; A63B 21/0422; A63B 21/045; A63B 21/0455; A63B 21/065; A63B 21/068; A63B 21/08; A63B 21/15; A63B 21/159; A63B 21/4003; A63B 21/4007; A63B 21/4011; A63B 21/4025; A63B 21/4027; A63B 21/4029; A63B 21/4031; A63B 21/4047; A63B 21/4049; A63B 2023/006; A63B 23/02; A63B 23/0205; A63B 23/0211; A63B 23/0216; A63B 23/0222; A63B 23/0233; A63B 23/0238; A63B 23/035; A63B 23/03516; A63B 23/03525; A63B 23/03533; A63B 23/03541; A63B 23/04; A63B 23/0405; A63B 23/0482; A63B 23/0488; A63B 23/0494; A63B 26/00; A63B 26/003; A63B 69/0057; A63B 69/0059; A63B 2069/0062; A63B 17/0054; A63B 2071/0063; A63B 2071/0072; A63B 2071/0081; A63B 2071/009; A63B 2208/0242; A63B 2208/0252; A63B 2208/0257; A63B 2208/0261; A63B 2208/0285; A63B 2210/50; A63B 2225/09; A63B 2225/093; A63B 2225/096
USPC .... 482/142–147, 907; 5/600, 613, 621, 624, 5/630, 632, 648, 649; 297/201
See application file for complete search history.

(56) References Cited

U.S. PATENT DOCUMENTS

| | | | | | |
|---|---|---|---|---|---|
| 3,227,440 | A * | 1/1966 | Scott | A61G 13/12 | 5/618 |
| 3,982,742 | A * | 9/1976 | Ford | A61G 13/12 | 5/624 |
| 4,144,880 | A * | 3/1979 | Daniels | A61H 1/0292 | 606/242 |
| 4,247,091 | A * | 1/1981 | Glowacki | A61G 13/0009 | 5/602 |
| 4,398,713 | A * | 8/1983 | Ellis | A63B 23/0211 | 482/145 |
| 5,042,800 | A * | 8/1991 | Walter | A63B 23/03575 | 297/411.1 |
| 5,308,359 | A * | 5/1994 | Lossing | A61H 1/0222 | 5/612 |
| 5,538,011 | A * | 7/1996 | Craft | A47C 15/008 | 128/845 |
| 5,971,901 | A * | 10/1999 | Shaw | A61H 1/0218 | 482/142 |
| 6,108,841 | A * | 8/2000 | Cameron | A61G 13/0009 | 5/624 |
| 6,435,611 | B1 * | 8/2002 | Walter | A47C 9/002 | 297/281 |
| 7,637,570 | B2 * | 12/2009 | Becker | A47C 7/28 | 297/312 |
| 7,832,401 | B2 * | 11/2010 | Torrie | A61G 13/0036 | 128/845 |
| 7,850,238 | B2 * | 12/2010 | Erb | A47C 1/024 | 297/321 |
| 8,172,736 | B2 * | 5/2012 | Contreras | A63B 21/00047 | 482/140 |
| 8,986,179 | B2 * | 3/2015 | Cares | A63B 21/0023 | 472/22 |
| 2003/0062750 | A1 * | 4/2003 | Walter | A47C 9/002 | 297/316 |
| 2003/0073552 | A1 | 4/2003 | Knight | | |
| 2003/0182726 | A1 * | 10/2003 | Greenfield | A61F 5/3776 | 5/648 |
| 2003/0199372 | A1 * | 10/2003 | Robinson | A63B 21/068 | 482/140 |
| 2007/0102968 | A1 * | 5/2007 | Pearse | A47C 7/024 | 297/158.1 |
| 2009/0134674 | A1 * | 5/2009 | Deck | A47C 9/002 | 297/118 |
| 2012/0056453 | A1 * | 3/2012 | Andoloro | A47C 1/026 | 297/195.11 |
| 2012/0126604 | A1 * | 5/2012 | Kuenzler | B60N 2/4249 | 297/391 |

FOREIGN PATENT DOCUMENTS

| | | |
|---|---|---|
| EP | 1486140 | 12/2004 |
| WO | WO 1993/019648 | 10/1993 |
| WO | WO 1999/016335 | 4/1999 |
| WO | WO 2012/010282 | 1/2012 |

OTHER PUBLICATIONS

International Preliminary Report on Patentability, for PCT/EP2013/053439, dated Sep. 9, 2014.

* cited by examiner

BALANCE BED

CROSS-REFERENCE TO RELATED APPLICATIONS

The present disclosure is entitled to the benefit under 35 U.S.C. § 120 and 365(c) of International Patent Application PCT/EP2013/053439, entitled: Balance Bed, filed: 21 Feb. 2013, which claims priority to German Patent Application 12001607.6, filed: 8 Mar. 2012, which are incorporated herein by reference in their entirety.

FIELD OF THE INVENTION

The invention relates to a recliner device for supporting a lying person having a foot and arranged thereon (i) a first movably mounted thigh support for supporting the first thigh of the person, (ii) a movably mounted second thigh support for supporting the second thigh of the person, the second thigh support being independent of the first thigh support and being combinable with the first thigh support to form a complete support, and (iii) a movably mounted back and head support that is independent of the first and second thigh supports for supporting at least the chest and/or the lower back of the person, wherein (A) each thigh support is allocated to a pivot bearing device that can be pivoted around a horizontal axis A at the respective thigh supports, (B) for each thigh support the pivot bearing device is allocated to the foot by means of a lever arm, (C) the back and head support is allocated to a pivot bearing device that can be pivoted around a horizontal axis A at the back and head support, (D) the pivot bearing device is allocated to the foot by means of a lever arm, and (E) the pivot bearing devices are allocated to the thigh supports and the back and head support, respectively, in such a manner that the weight of the lying person is received mainly at the thigh and the back, and that the pivot bearing devices can be freely pivoted in a lying state by balancing.

BACKGROUND OF THE INVENTION

Seating devices with partial seats for supporting a sitting person are known. The person can take a seat on both partial seats, and the partial seats can support the person independently of each other. WO 93/19648 relates to an active-dynamic seating device consisting of a foot, an intermediate part allocated to the foot, and a seat part allocated to the intermediate part, wherein the seat part is constructed as two parts. The seat halves are allocated independently of each other mainly vertically elastically to the intermediate part and each seat half features a bearing part and thereon a seat half. Each seat half is mounted so as to be tilted back and forth on the bearing part. WO 99/16335 A1 discloses a seat with a pair of seating bodies, each of which allow for a vertical movement as well as for a tilt movement back and forth. From US 2003/0073552 A1 an adjustable rigid seating device with sensors is known, wherein the frame supports the whole body of a user and allows for resistance exercises.

Recliner devices are typically constructed planar over the whole surface, such as a bed or an arm chair, so that the person half-sitting and half-lying is supported ergonomically in the back area. Examples of this are lounge and massage chairs with a half-lying position. Recliner devices such as, for example, operating tables allow for the independent support of the left and right lower leg and thigh rests, the upper body, the arms and the head. The recliner devices of the state of the art have in common that they dictate the posture of the lying person or support a specific posture. In particular, the angle and the longitudinal rotation of the chest to the pelvis are not freely and spontaneously movable and, in addition, are most often dampened by a cushion and/or a back rest. The state of the art does not teach a free torsional movement between chest and pelvis for recliner devices.

The problem with malpositions, muscle tensions and spine malpositions is that the lying or sitting position of the people concerned is fixed and any relaxing movements are blocked. Even though a water bed does adapt to the respective pressure points of the head, the back and the pelvis, it does, however, not offer the necessary degrees of freedom for movements that heal or even render malpositions, muscle tensions and spine malpositions tolerable. Moreover, with water beds the pressure wave phenomena strongly influence the movement of the person. A further medical problem are people with underdeveloped muscle tonus or which have lost muscle tonus because of a disease or accident, and which have to relearn muscle tonus and balance by physiotherapy. These physiotherapeutic exercises are typically accompanied by a physiotherapist and often require complex and expensive orthopedic devices. Furthermore, physiotherapeutic exercises are limited in time because of medical attendance and the work associated therewith.

It is the object of the present invention to allow for an improved reclining, in particular in such a manner that a fatigue-free and comfortable reclining is possible. Furthermore, a device is to be provided that allows the person using it to recline in its natural body posture. Moreover, the device should exercise the sense of balance and the muscle tonus associated therewith. In addition, the device should counteract the problems of permanently lying people with skeletal and muscle pains as well as bedsore, i.e. decubitus.

This object is solved according to claim 1 by means of a recliner device (1) for supporting a lying person having a foot (2) and arranged thereon:

a first movably mounted thigh support (3) for supporting the first thigh of the person, a movably mounted second thigh support (4) for supporting the second thigh of the person, the second thigh support (4) being independent of the first thigh support (3) and being combinable with the first thigh support (3) to form a complete support, and a movably mounted back and head support (5, 6) that is mounted independent of the first and second thigh supports (3, 4) for supporting at least the chest and/or the lower back of the person, wherein each thigh support (3, 4) is allocated to a pivot bearing device (8, 9) that can be pivoted around a horizontal axis A at the respective thigh supports (3, 4), for each thigh support (3, 4) the pivot bearing device (8, 9) is allocated to foot (2) by means of a lever arm (10, 11), the back and head support (5, 6) is allocated to a pivot bearing device (14) that can be pivoted around a horizontal axis A at the back and head support (5, 6), the pivot bearing device (14) is allocated to foot (2) by means of a lever arm (15), and the pivot bearing devices (8, 9, 14) are allocated to the thigh supports (3, 4) and the back and head support (5, 6), respectively, in such a manner that the weight of the lying person is received mainly at the thigh and the back, and the pivot bearing devices (8, 9, 14) can be freely pivoted in a lying state by balancing.

Surprisingly, it was found that a recliner that supports the lying person at the back and the thighs independently of one another does not only support the person stably but also supports the natural balance of the lying person as well as its natural lying posture. Because of the thigh supports and the back and head supports that can be pivoted around a horizontal axis, the lying person is freely movable in its optimal balance position along its longitudinal axis (along the spine) and this state is stabilized by permanent small movements. After getting used to the seemingly unstable state the positional correction is unconscious, and there is a feeling of weightlessness that is comparable to floating in water. The seemingly unstable reclining condition promotes the balance movement and the muscle tonus of the lying person. The free movement of the body and the legs without direct support of the pelvis is suited to heal malpositions, muscle tensions and spine malpositions. It is an advantage that the person can itself operate the recliner device after a short familiarization and so is treated without physiotherapeutic assistance over the whole body region from the neck down to the pelvis.

The neuronal coordinating programs that are anchored in the nervous system and that can be activated by the recliner device of the present invention are more important than the innate or learned body posture. The resulting reclining position is very relaxing and is sensed as emotionally positive. Also, the recliner device of the present invention has a very strong therapeutic effect on posture, muscle and neuronal diseases. The body is inspired by pressure points and motion feedback information (feedback effects) to move in its most natural and most original form. The spine is also gently extended in the freely movable lying position, and the muscle groups associated therewith are relaxed. Minute movements of a body part such as e.g. a foot, an extremity or a finger trigger perceptible whole body movements. These are very relaxing. Furthermore, coordination processes of the body are exercised or learned again. In addition, the touch and movement senses of the lying person are noticeably improved by the effects of the recliner. This is very advantageous from a therapeutic point of view because the patient can react much stronger to therapeutic measures. Because of the coordinating and feedback movements that are necessary for balancing, the person lying according to the invention gets the impression that it is floating or lying on water.

A further advantage of the recliner of the invention is the support of micro-movements, for example, very small movements such as those of breathing, the hand, the head, the foot, very small adjustments of the body's balance point, or the balance point of individual body parts. The lying person compensates pressure perception, for example, initiated by other people, devices and rest surfaces, which inhibit long-term consistent strain of the joints, the spinal discs and the muscular system. For this reason the recliner of the present invention is best suited to counteract the decubitus of a permanently lying person by means of micro-movements and, thus, to avoid bedsore, muscle atrophies as well as muscle and skeletal pains.

For lying down the person can take a seat on top of the thigh supports in such a manner that each support supports one thigh, respectively, and by doing so, supports the left and right lower body and thereon supports the lower body halves pivotably.

The back and head support supports the back or the chest and the head in longitudinal direction of the lying person in a pivotable manner, i.e. pivotably along the spine. All three supports in combination lead to a strain-free and freely movable three-point mounting of the pelvis, i.e. at the spine and at both thigh joint sockets, which—next to the free movement of the pelvis along the longitudinal axis—also allow for side rotation of the pelvis. The freely movable three point mounting of the pelvis allows advantageously for a particularly relaxed and comfortable lying position that is comparable with backside floating in water and which largely takes the strain from the back around the pelvis.

It is advantageous if the pivot bearing devices are allocated to the thigh supports and the back and head support, respectively, in such a way that the weight of the lying person is received mainly at the thigh and the back and the pivot bearing devices can be freely pivoted in a lying state by balancing. This means that the pivot bearings are positioned advantageously at the respective balance point of the thigh or the back and head support, in such a manner that a three point mounting results that can easily be adjusted by the lying person. Preferably, the pivot bearing devices for the thigh supports and/or the back and head support are positioned directly underneath each support, preferably at the point of balance of the thigh or back and head supports. If needed, for example, when specific muscle groups are to be exercised preferably, the pivot bearings can also be positioned before or behind the balance points of the thigh or back and head support in order to ease or hinder the pivot movement in one direction.

A pivot movement that is essentially without restraint and that is perceived as easy by the lying person promotes the "winding" of the pelvis and the spine as well as of the muscles, tendons, spinal discs and skeletal bones.

In embodiments of the recliner device both lever arms (10, 11) of the thigh supports (3, 4) and preferably also the lever arm (15) of the back and head support (5) are flexure elastic and can preferably be bent by the lying person by 5 to 30°, more preferably 5 to 20° in vertical direction C. Because of this, the lying person can additionally influence its lying position on the three point mounting of the two thigh supports and the back and head support by shifting its weight, for example, by positioning the three supports in different height positions relative to each other depending on a shift in weight.

Moreover, it is a preferred embodiment of the invention that both lever arms (10, 11) of the thigh supports (3, 4) and preferably also the lever arm (15) of the back and head support (5) are torsion elastic and can preferably be twisted by the lying person by 5 to 90°, more preferably 5 to 60°. These additional degrees of freedom facilitate sideway rotations of the lying body because the supports move sideways together with the body or the body parts lying thereon and do not hinder this rotation movement or at least to a small extent only.

Recliner devices according to the invention, wherein both lever arms (10, 11) of the thigh supports (3, 4) and preferably also the lever arm (15) of the back and head support (5) are flexure elastic and torsion elastic, are particularly preferred.

In a preferred embodiment of the recliner device of the present invention, for each thigh support (3, 4) the pivot bearing device (8, 9) is allocated to the foot (2) by means of a lever arm (10, 11) and a pivot bearing (12, 13) that can be pivoted around a vertical axis B. By way of these preferred pivot bearings the thighs of the lying person can be spread apart in the supports freely and independently of each other by allocating one of the optional pivot bearings at the foot to the thigh supports by means of a lever arm and impart to the lying person that its pelvic is without support and completely free to move. Hence, in this preferred embodiment the thigh supports offer per each support two degrees of freedom in longitudinal and diagonal direction that can be combined freely with each other.

In a preferred embodiment of the recliner device of the invention, the lever arms (10, 11) of the thigh supports (3, 4) are together allocated to the foot (2) by means of a pivot bearing (20) that can be pivoted around a vertical axis B, wherein the pivot bearings (12, 13) of the lever arms (10, 11) are preferably allocated to foot (2) by an additional pivot bearing (20) that can be pivoted around a vertical axis B. This pivot bearing (20) that is allocated to both thigh supports (3, 4) connects the thigh supports (3, 4) movably and orientates these relative to each other.

A rigid or more preferably a pivotable lower leg support (16, 17) are preferably allocated to each of the thigh supports of the recliner of the invention. Preferably, these lower leg supports (16, 17) are pivotable in several or all directions, preferably with a different resistance or effort depending on the pivoting direction. In this regard, it is preferred that a movement in vertical direction (up/down) is opposed by more resistance than a movement in horizontal direction (left/right). With lower leg supports that are allocated pivotably the lying person can vary the angle between upper and lower leg and, thus, influence its overall balance position. In addition, the lower leg supports improve the well-being and stability perception of the lying person similar to a lounge chair that rests the legs, in particular, if the pivoting movement of the lower and upper leg support is limited. In a preferred embodiment the pivoting angle of the pivot bearing device between the thigh and lower leg support is no more than 90°, preferably no more than 100°, more preferably no more than 110°. In a preferred embodiment each thigh support (3, 4) is allocated to a lower leg support (16, 17), respectively, either in a fixed manner or by means of a pivot bearing device (18, 19) that can be pivoted around a horizontal axis A.

The thigh supports (3, 4) and/or the back and head support (5) can be allocated to foot (2) or its base plate (25) directly by means of the respective lever arms (10, 11, 15) or the pivot bearing devices and pivot bearings.

In an alternative and advantageous embodiment, the lever arms (10, 11) of the thigh supports (3, 4) and/or the lever arm (15) of the back and head support (5) are allocated to the foot (2) by means of at least one pivot bearing device (21) that can pivot around a longitudinal axis C, wherein the lever arms (10, 11) and/or the lever arm (15) are preferably allocated to the foot (2) by means of a pivot bearing device (21) at the base plate (25) that can be pivoted around a longitudinal axis C. In other words, the lying person can pivot the thigh supports (3, 4) and/or the back and head support (5) along longitudinal axis C to the right or left and, thus, gain an additional degree of freedom that positively influences the balance perception and muscle tonus.

However, it is preferred that the displacement of the pivot bearing device(s) (21) is limited to the sides so that falling to the side is avoided for people with an impaired balance perception. It is advantageous if the limit is such that the at least one pivot bearing device (21) can be pivoted around longitudinal axis C by at least 2 to 20, preferably by 2 to 15, more preferred 5 to 10°.

Advantageously the recliner device of the invention has at least one pivot bearing device (21) around longitudinal axis C with a restoring force, and/or it can be pivoted in a decelerating manner.

The at least one pivot bearing device (21) around longitudinal axis C can, for example, be allocated to the base plate (25) or the foot (2) (i) at the connection or the connections of the foot (2) to the base plate (25), (ii) at the connection(s) of the lever arms (10, 11) of the thigh supports (3, 4) and/or at the connection of the lever arm (15) of the back and head support (5). However, the pivot bearing device (21) can also be allocated in a different manner to the lever arms (10, 11, 15) and/or at the connections of these lever arms to the supports or their pivot bearings. A further alternative for the side deflection of the supports (3, 4 and/or 5) in the lying state can be implemented by torsion elastic lever arms (10, 11, 14).

It is further preferred that at least one of the pivot bearing devices (8, 9, 14, 18, 19, 21) of the recliner of the invention is a pivot bearing device that can be pivoted with a spring rigidity. The spring rigidity of the pivot bearing device supports in particular beginners and people weak in tonus to find back into a stable position. The spring rigidity leads to the effect that a spring force acts against the deflection of the pivot bearing that leads the pivot bearing back into its original position once the lying person no longer exerts any force on the bearing. It is of advantage if the spring force increases with the extent of deflection. Upon deflection the spring force supports the counter movement and, thus, supports the movement desire of the lying person. Also, the spring rigidity counteracts an excessive movement of the lying person and increases its stability perception. The spring rigidity can also intensify the weight-less, seemingly swimming perception of the lying person and can dampen the pressure to the thigh support or the back and head support.

In this context it is also preferred that at least one of the pivot bearings (12, 13, 20) of the recliner is a decelerating pivot bearing. It is especially preferred if at least one of the pivot bearing devices (8, 9, 14, 18, 19, 21) and/or at least one of the pivot bearings (12, 13, 20) has a restoring force. It is also preferred that the braking force of the decelerating pivot bearings increases with the extent of deflection of the pivot bearing. This also counteracts an excessively strong movement of the lying person and increases its stability perception. It is further preferred that at least one of the pivot bearing devices (8, 9, 14, 18, 19, 21) is a decelerated pivot bearing device.

The pivot bearings of the thigh supports (3, 4) are preferably allocated to the foot (2) by means of a common base plate (25) so that the shift of the base plate (25) also shifts both pivot bearings (12, 13) and, thereby, the lever arms (10, 11) as well as the allocated thigh supports (3, 4).

The angle of at least one of the lever arms (10, 11, 15) allocated to at least one of the thigh supports (3, 4) and/or the back and head support (5) relative to the horizontal is preferably between 5 and 90, more preferably 10 and 70, most preferably between 15 and 60°. It is further preferred that the angle of at least one of the lever arms (10, 11, 15) relative to the horizontal is adjustable. Because of this the recliner device can be adapted to the needs and body dimensions of the lying person. Depending on the length and angle of the lever arm the position of the thigh support or the back and head support changes in height and/or distance relative to each other.

In a preferred embodiment of the recliner of the invention, the pivoting angle of at least one of the pivot bearing devices (8, 9, 15) to at least one of the lever arms (10, 11, 14) can be limited, i.e. cannot be exceeded by the lying person. This limitation of the pivoting angle facilitates the entry as well as the exit from the recliner device of the invention.

Naturally, different people have different body lengths, a different length distribution of body and extremities as well as different weight distributions of body and extremities. In order to cope with these differences and to ensure an optimal balance distribution between the thigh supports and the back and head support for all types of people, the distance of the thigh supports (3, 4) to the back and head support (5, 6) can be designed adjustable at the foot (2). For example, the thigh supports (3, 4) and/or the back and head support (5) can be arranged adjustably on a bar guide (24), and the respective position can be fixed with a safety pin or some other kind of arrest device.

In further preferred embodiments of the recliner device of the present invention, a side support for the chest and/or back can be allocated to the movably mounted back and head support. This side support can, for example, be realized merely in the form of adhesive surfaces on the back and head support that avoid a slip of the lying person, in the form of one or more belts, and/or in the form of side supports as they are, for example, implemented for seats in sports cars. In particular, such a side support has a psychological effect on the lying person. Typically, the lying person can keep its balance on a sufficiently wide back support so that an additional side support is not necessary. A strongly shaped side support is only required if the lying person is impaired in its balance, e.g. by maldevelopment, by disease, e.g. stroke, or injury. For healthy people with normal balance senses it most often suffices that the back support is designed as anti-slip.

For example, the back and head support with or without side support can be one-piece, or two-piece with separate back and head support, or three-piece (or also multiple-piece) with separate head-, upper- and lower back-support. For the two- or multi-part arrangements the individual elements are connected rigidly, flexibly and/or movably to each other. For example, the elements of the two- or three-piece back and head support can be allocated by means of one, two or several lever arms. This or these can be rigid or have a spring rigidity. Alternatively, or additionally to the lever arm, individual or all elements of the two- or three-piece back and head support can be pivoted vertically around a horizontal axis A so the back and head support allows a "winding" of the spine in this region. The back and head support advantageously also allows for a limited rotation of the support at least in the back region so that the sideways rotation around the longitudinal axis C of the lying person is supported to a limited extent and without the person losing side support. In a preferred embodiment the present invention relates to recliners with a movably mounted back and head support (5, 6) selected from a one- or two-piece back and head support; a three-piece head-, upper- and lower back support, wherein each of the individual elements of the two- or multi-part arrangement are connected rigidly, flexibly and/or movably to each other, and wherein the pivot bearing device (14) is allocated to the back support (5) or the lower back support (5*a*).

The pivot bearing device that assigns the back and head support (5) to the foot (2) by means of the lever arm (15) is preferably allocated to the back support or the lower back support (5*a*) so that the center of balance of the upper body of the lying person rests on the pivot bearing device or in short distance thereto.

In a preferred embodiment, the lower back support (5*a*) contributes only to a limited extent to the support of the lying person and only serves the purpose of the comfortable feeling that the lower back is supported and, in contrast to the pelvis, is not hanging freely.

In a preferred embodiment, the pivoting angle of the pivot bearing device (14) around the horizontal axis A that is allocated to the back and head support (5, 6) is limited, and pivot bearing device (14) preferably has a restoring force. The limitation of the angle and the preferred restoring force facilitate the entry into and exit out of the recliner device of the invention.

Foot (2) of the recliner device of the present invention must safely keep the device in position during lying operation as well as for the entry and exit of the person using the device. Depending on need and aesthetic considerations, foot (2) can be constructed as one piece, for example as a block or as a frame with legs, typically with at least four of these. Alternatively, the foot can be only a rail safely fixed to the floor for receiving the thigh supports as well as the back and head support. In addition, the thigh support as well as the back and head support can be fixed separately to the floor. In that case the foot is a multiple part design. The foot only needs to fulfill its function, i.e. allocate the thigh- as well as the back and head support in such a way that the function of the inventive recliner is enabled, i.e. the supports are spatially allocated to each other that a person in lying position can lie down according to the invention. Last but not least, the foot can also be fixed to the ceiling or wall as long as it ensures a spatially stable allocation of the supports. In order to support the free floating or swimming perception or to dampen the movements of the person, the foot and/or the lever arms can be mounted in a dampening or elastic manner, e.g. on rubber and/or spring bearings. Also, the foot can be constructed movable by means of rolls or a lever arm, wherein the rolls can be removed during lying operation, can be fixed or be without function, and the lever arm is preferably fixed spatially during lying operation. In further embodiments at least one movable part of the recliner device of this invention is lockable or adjustable by machinery, for example by means of electric motors. In this regard, the distance of the thigh supports to the back and head support, the angle of the lever arms and the angle of the supports to the foot can be locked or adjusted by machinery. Also, the angles of all the pivot bearing devices can be changed and locked advantageously, if this is necessary or beneficial, for example when entering or exiting the recliner device.

In further embodiments of the recliner device at least one movable part of the recliner device can be programmed to be locked and/or adjustable by machinery. A programming can be of advantage to convert the recliner device for the entry and exit to a stable seating or standing device. In the lying state the pivot bearing devices and pivot bearings are then again freely movable by the lying person. The programming can also be designed so that the pivot bearings are definably decelerated and/or the pivot bearing devices have a defined spring rigidity.

In this respect the present invention relates in a preferred embodiment to a preferably machine-adjustable, preferably programmable recliner device that can be adjusted from a lying position into a sitting or standing position and vice versa.

The formed components for receiving the thighs, the lower legs, the lower back, the back and/or the head can be adapted more or less to the form of the respective body part, or are adaptable by altering the form of the components according to the respective body part. For example, the support can merely be a planar board, preferably with cushioning. It is preferred that the respective support is adapted or adaptable to the anatomy of the supported body part of the lying human, for example by mechanically adjustable elements and/or by inflatable and, thus moldable elements. Such shaping systems are known from the car industry for car and airplane seats. The surface of the supports can be advantageously designed as being slip resistant, breathable, cushioned, ventilating and/or heating.

Also, the supports can be constructed to be massaging by means of continuously moving elements.

Within the context of the present invention, the terms vertical, horizontal and longitudinal or vertical axis B, horizontal axis A and longitudinal axis C are not limited to absolute orientations but also include those deviations of the mentioned orientations that can be used for practicing the invention. In other words, the skilled person recognizes that the horizontal axes A can be deflected in vertical and/or longitudinal direction to such an extent that pivot bearings oriented to the horizontal axis A of the lying person still allow for a vertical deflection, for example, of the legs in the thigh supports or of the back in the back and head support. Also, the vertical axes B can be deflected horizontally or in longitudinal direction to the extent that it is still acceptable for the lying person. For example, the pivot bearings (12, 13) or the common pivot bearing (20) of the levers for the thigh supports (3, 4) can be rotated around an inclined vertical axis B, as it is shown in FIG. 2 for the common pivot bearing (20). Typically, the deflection of the vertical-, horizontal- and longitudinal axis is less than 60, preferably less than 45, more preferably less than 40 or 35 and most preferred less than 30 or 20 degrees.

A lever arm as used herein for describing the invention is any device that spatially allocates two elements over a defined distance. Typically, lever arms are rigid, elastic or torsion elastic bars, beams, etc. that can be constructed as one- or multiple-part elements. For example, by partitioning the lever arm into two or more parts along its longitudinal direction and by changing the distance between these two or more parts of the lever arm, the flexural and torsional strength can be modulated.

Further advantages, features and details result from the following description in which—if applicable with reference to drawings—at least one embodiment is described in detail. Features described and/or presented by the drawings form the subject-matter of the present invention either by themselves, or by arbitrary and reasonable combination, possibly independently of the claims and can also represent one or more separate inventions. Same, similar and/or functionally equivalent features are designated by the same reference signs.

DETAILED DESCRIPTION

Figure 1:
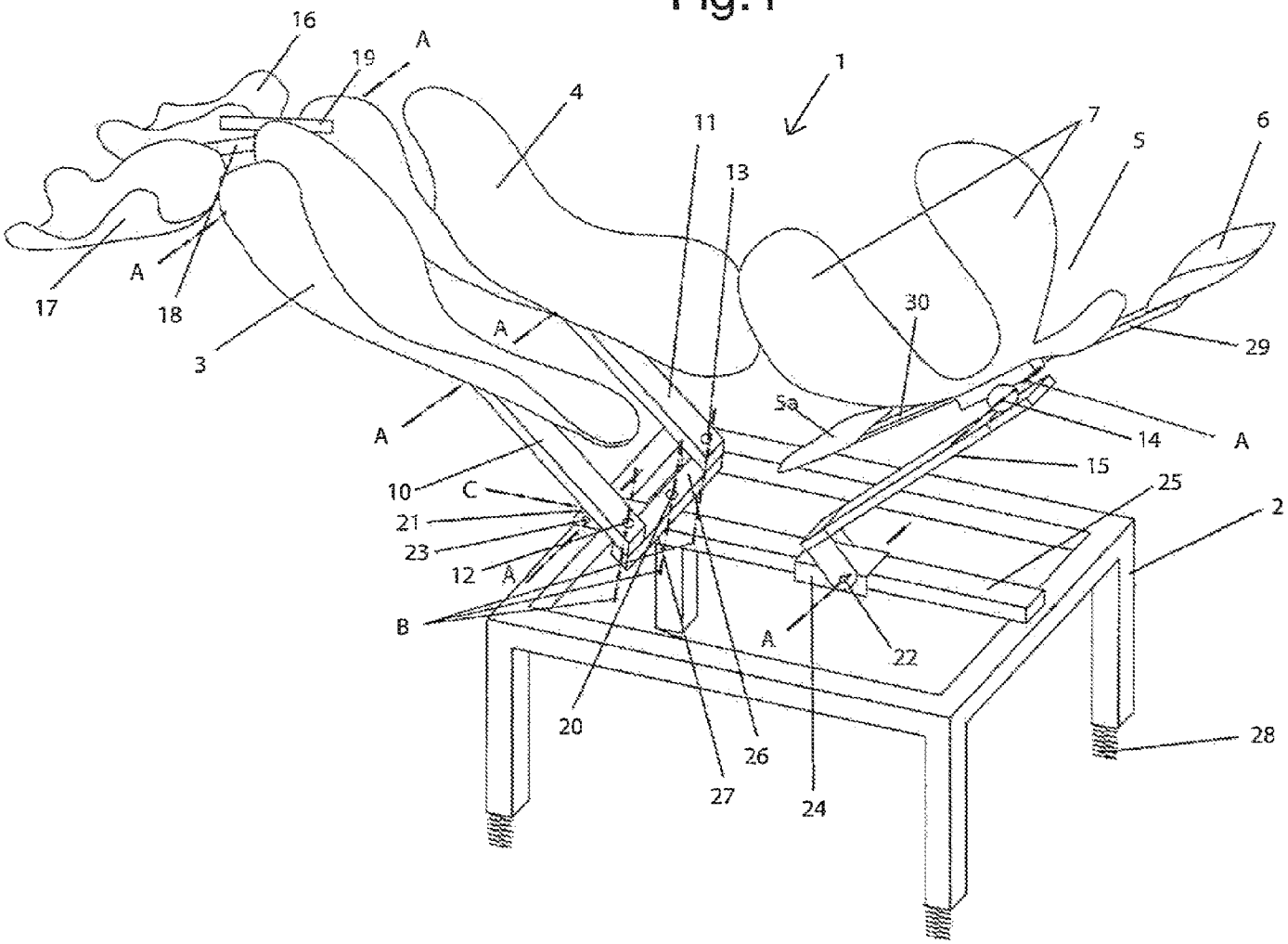
FIG. 1 a three-dimensional view of a recliner device (1) of the invention with reference numerals as seen from an upper rear angle.

FIG. 1 shows a three-dimensional view of a recliner device (1) of the invention from an upper rear angle for supporting a lying person that is not described. The recliner device (1) has a stable foot (2) designed as frame with four legs with damping elements (28) at each leg end. Base plate (25) is positioned on the foot (2), to which the mount of the leg unit, in the present case the connecting piece (26) with pivot bearing (20), and the movable slide (24) of the back and head support (5) with the pivot bearing for the back unit (22) is pivotably combined. The back and head support (5) can be moved towards to and away from the leg unit with slide (24) and can then be fixed. In a preferred embodiment, only the leg unit or also the leg unit can be constructed movably, for example, by means of a slide on the base plate (25).

In the present preferred embodiment the leg unit consists of the connecting piece (26) with the pivot bearing (20) that can be pivoted around the vertical axis. The pivotable connecting arm (26) is allocated to the lever arms (10, 11) preferably by means of first and second pivot bearings (12, 13), wherein the lever arms are also allocated to the first and second thigh supports (3, 4) by means of first and second pivot bearing devices (8, 9). The first and second thigh supports (3, 4) are preferably each connected to optional and preferred first and second lower leg supports (17, 16) via pivot bearings (18, 19). Particularly in the lying state at least the pivot bearing devices (8, 9, 14) can be pivoted freely by a balancing person. However, also the lever arms (10, 11) of the thigh supports (3, 4) and/or the lever arm (15) of the back and head support can be flexure elastic, torsion elastic or both and further extend the lying person's degrees of movement freedom.

In the present preferred embodiment the back and head unit (5) consists of the movable and fixable slide (24) that allocates this unit to base plate (25), as well as the pivot bearing (22) that movably allocates the lever arm (15) of the back and head support (5). The lever arm (15) is allocated to the back and head support (5), preferably by means of the pivot bearing device (14) that is preferably positioned at the balance point of the back of the lying person. However, the position of the pivot bearing device (14) can also be before or behind the balance point of the back of the lying person so that an intended instability results which the lying person can compensate by an appropriate posture. The back and head support (5) can be formed as one piece rigidly or movably, it can be formed as two parts by a back- (5) and a head piece (6) and a connection, for example in the form of a rigid, flexure elastic and/or torsion elastic lever (29), or it can be formed as three parts, i.e. two parts with an additional lower back support (Sa), wherein the lower back support of the back support (5) can be allocated by means of a rigid, flexure elastic and/or torsion elastic lever (30). It is an advantage if the positions of the head-, back- and lower back supports (6, 5, 5*a*) can be adjusted in the distance to each other, so that the supports can be adjusted to the anatomy of the lying person. A side support (7) of the back support can also be an advantage, which imparts more safety for the lying person and which can avoid a fall for balance-impaired people. However, a stable use is already ensured with a skid-free surface of the supports (5, 5*a*, 3, 4). In order to achieve the effect of the invention, one only needs the pivot bearing devices (8, 9, 14) of the thigh-, back and head supports. This means that the connection of the lever arms (10, 11, 15) of these supports (3, 4, 5) with the base plate (25) can also be fixed and the lying person will still be "swimming" on the back. All further degrees of freedom by additional pivot bearing, for example pivot bearings 12, 13, 20 and additional pivot bearing devices, for example 22, 27, 18, 19, 21 amplify the feeling of zero gravity. For this reason, the skilled person recognizes that the construction of the lever arms 10, 11 and 15 as well as their allocation to the base plate (25) (or possibly even to several base plates) and the foot (or possibly even several feet) can be effected in many and very different ways, as long as the weight of the lying person is basically received at the thigh and the back, and as long as the pivot bearing devices 8, 9, 14 can be freely moved from a lying state from the balance position of the person.

The pivot bearing 23 at the end of the base plate allows for raising the base plate (25) towards the feet so that the lying person is transferred into a sitting or standing position. The sitting or standing position in the "opened" state facilitates the entry and exit. Preferably the transfer from the lying to the sitting/standing position is mechanically supported and stabilized, for example by actuators.

In a preferred embodiment the base plate (25) is allocated pivotably to the foot (2) by means of at least one pivot bearing device (21) around longitudinal axis C, so that the lying person can rotate along its longitudinal axis together with the leg supports (3, 4) and/or the back and head support (5) to the right and left sides. Preferably, this at least one pivot bearing device (21) is decelerated and/or supplied with a restoring force so that the lying person cannot roll sideways off supports (3, 4, 5). The at least one pivot bearing device (21) is pivotable around longotudinal axis C, preferable by at least 2 to 20, preferably at least 2 to 15, more preferably 5 to 10°.

Figure 2:
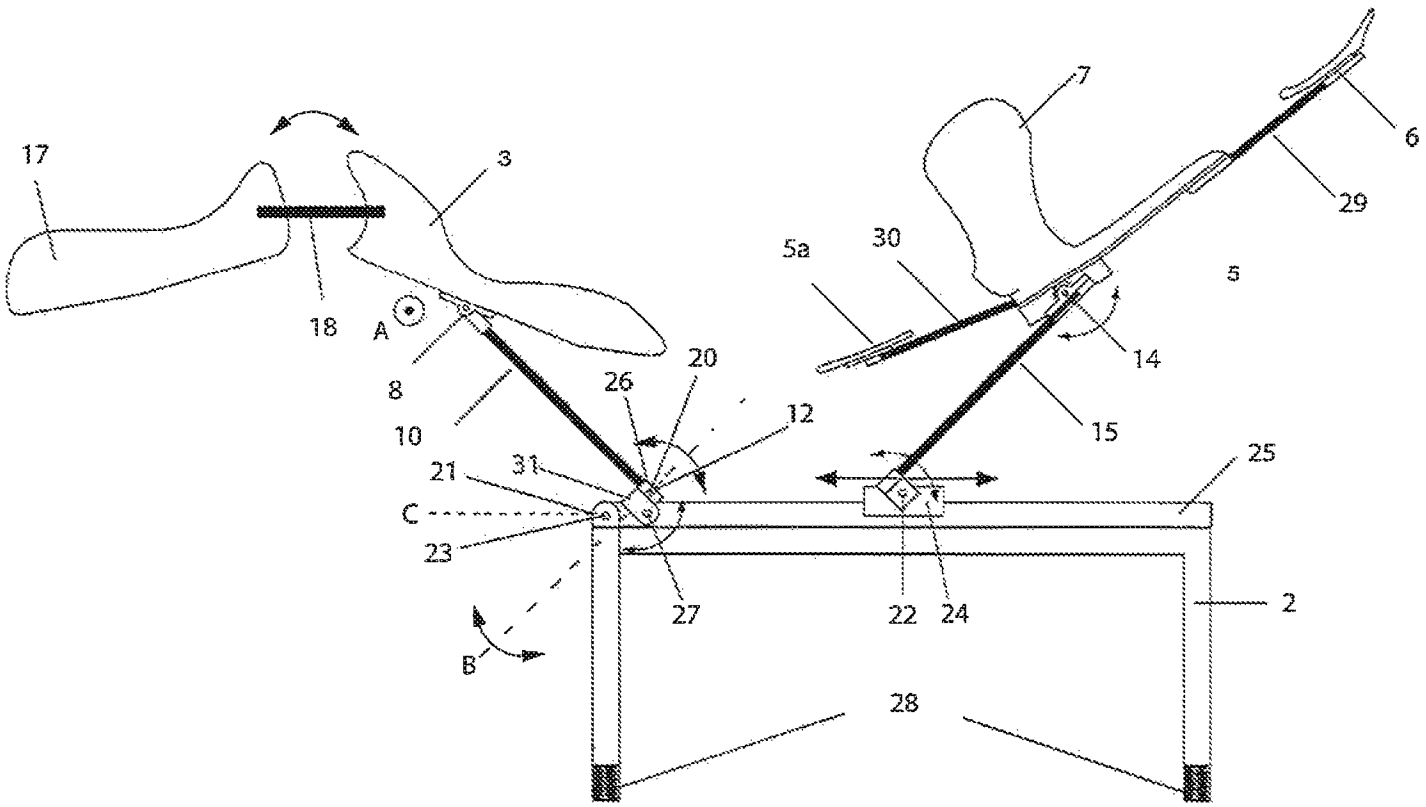
FIG. 2 a side view of a recliner device (1) of the invention of FIG. 1.

FIG. 2 shows a side view of the recliner device of the invention (1) of FIG. 1. However, the connecting piece (26) to the first lever (10) of the first lower leg support (3) is connected to the base plate (25) by means of a pivot bearing (27). The pivot bearing device (18) between thigh and lower leg support (3, 17) is designed das flexure- and torsion elastic bar.

Figure 3:
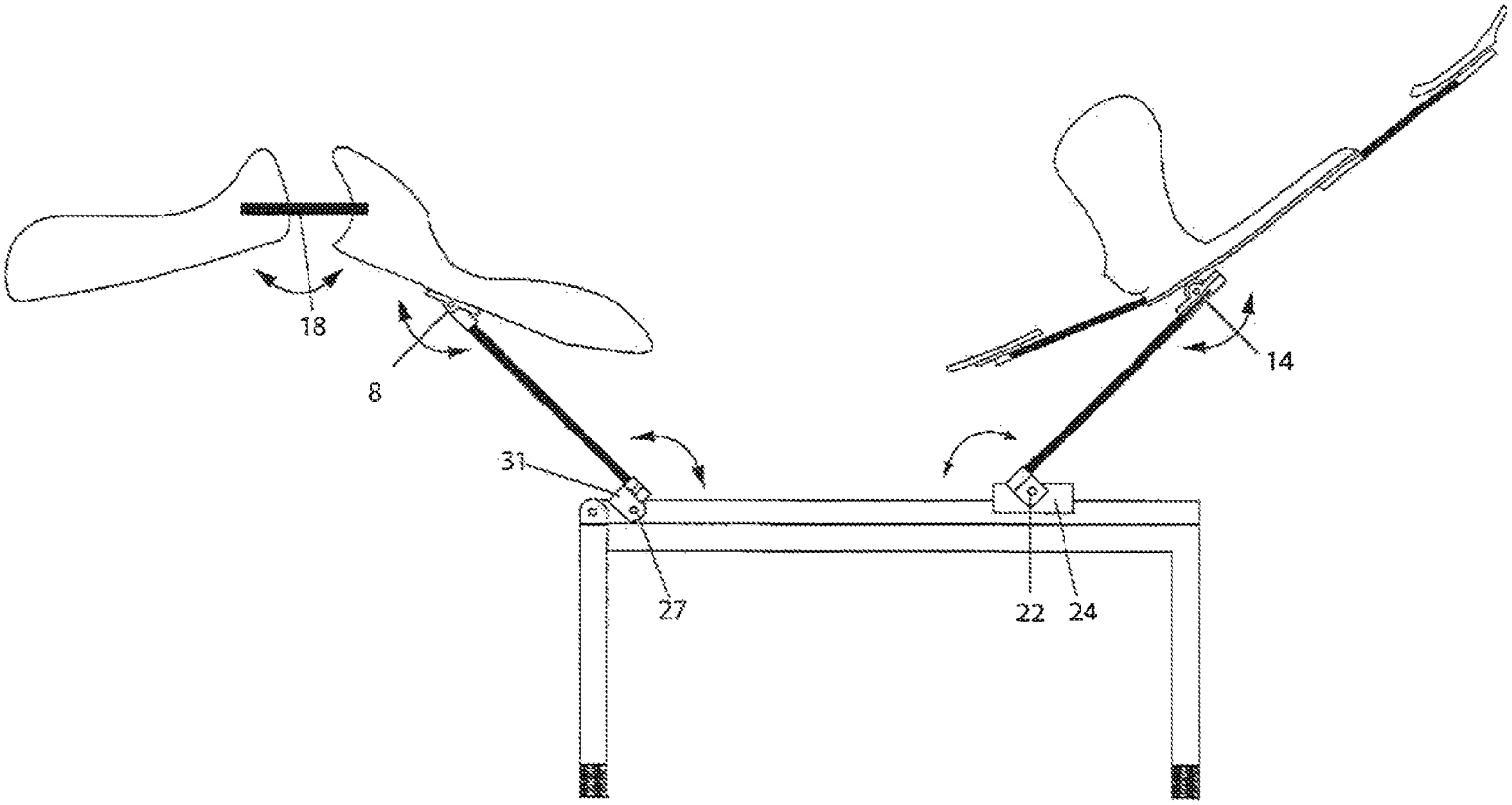
FIG. 3 a side view of the recliner device (1) shown in FIG. 2 with an extended distance between the slide (24) or the pivot bearing of the back unit (22) allocated to the slide and the pivot bearing of the leg unit (31)

FIG. 3 shows a side view of the recliner device of the invention (1) of FIG. 2 with an extended distance between slide (24) or the pivot bearing of the allocated back unit (22) and the pivot bearing of the leg unit (31). The extended distance adapts the recliner device (1) to the longer back of a lying person or leads to a lower back position that can be compensated by the lying person by tensioning of the back musculature and, thus stabilizing its lying position. Additionally, the diverse pivot bearing deflections are described by double-sided arrows. Preferably, the lever arms are designed to be flexure elastic and/or torsion elastic and thereby extend the degrees of freedom of the lying person and also dampen or amplify the wave movement originating from the lying person.

Figure 4:
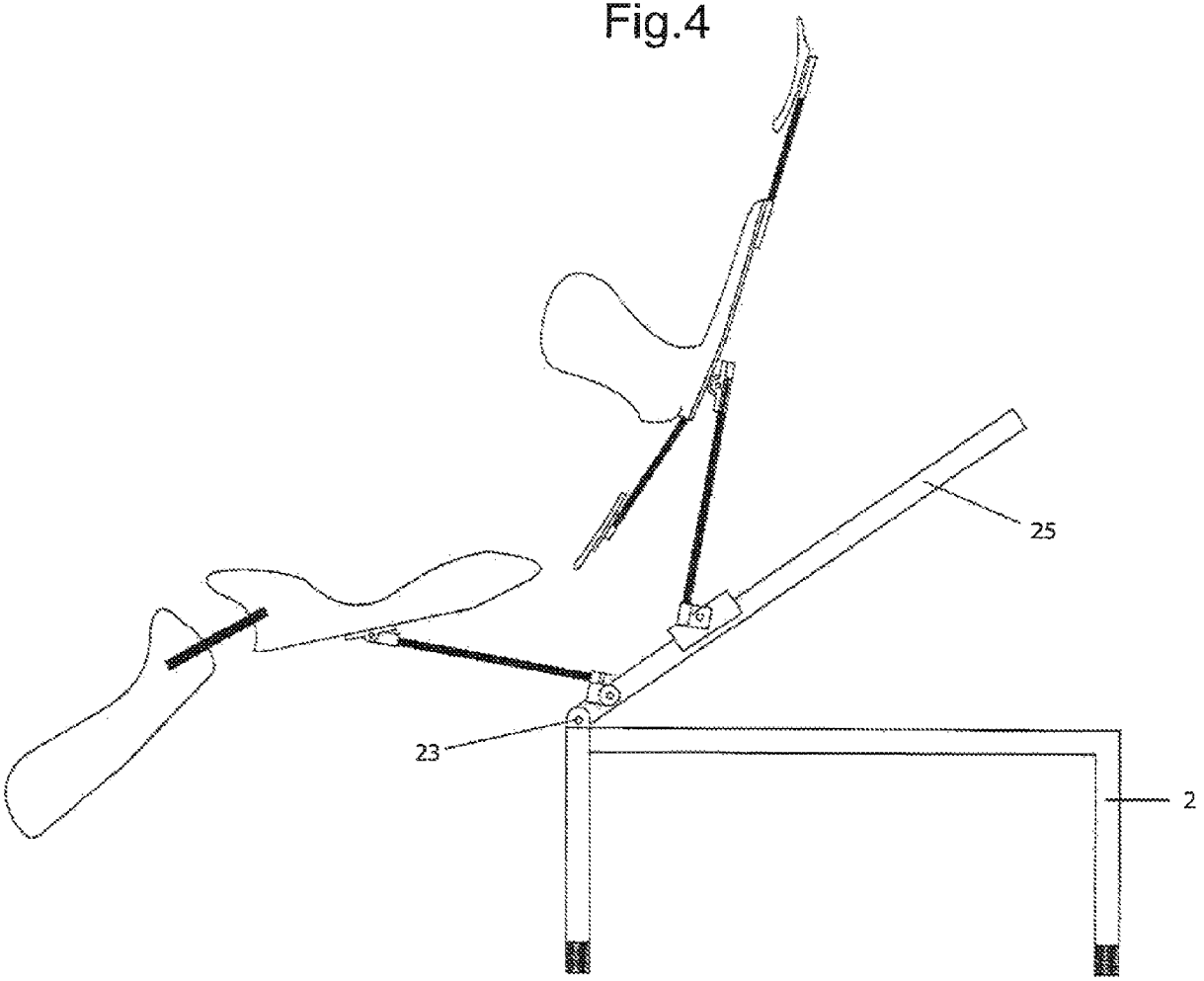
FIG. 4 a side view of the recliner device (1) as shown in FIG. 2 in entry and exit position with a tilted pivot bearing (23) opposite the base plate.

FIG. 4 shows a side view of the recliner device (1) shown in FIG. 2 in entry and exit position with pivot bearing (23) tilted relative to the base plate (25). It is preferred to decelerate the pivot movement of pivot bearing (23) or even to install a restoring force so that the transition from the entry-/exit position to the lying position does not occur jerkily and possibly uncontrolled by the lying person. The restoring force towards the sitting-/standing- and exit position facilitates the transition of the lying person into the sitting-/standing- and exit position, and the restoring force or decelerating force avoids a jerky swing-out during transition into the lying position. Moreover, during transition from the lying position into the entry- and exit position the distance between the leg unit and the back unit can be shortened by means of the slide of the back unit, which improves the entry- and exit position in the seated state. The change in distance of both units toward each other can be executed manually or by means of actuators.

Figure 5:
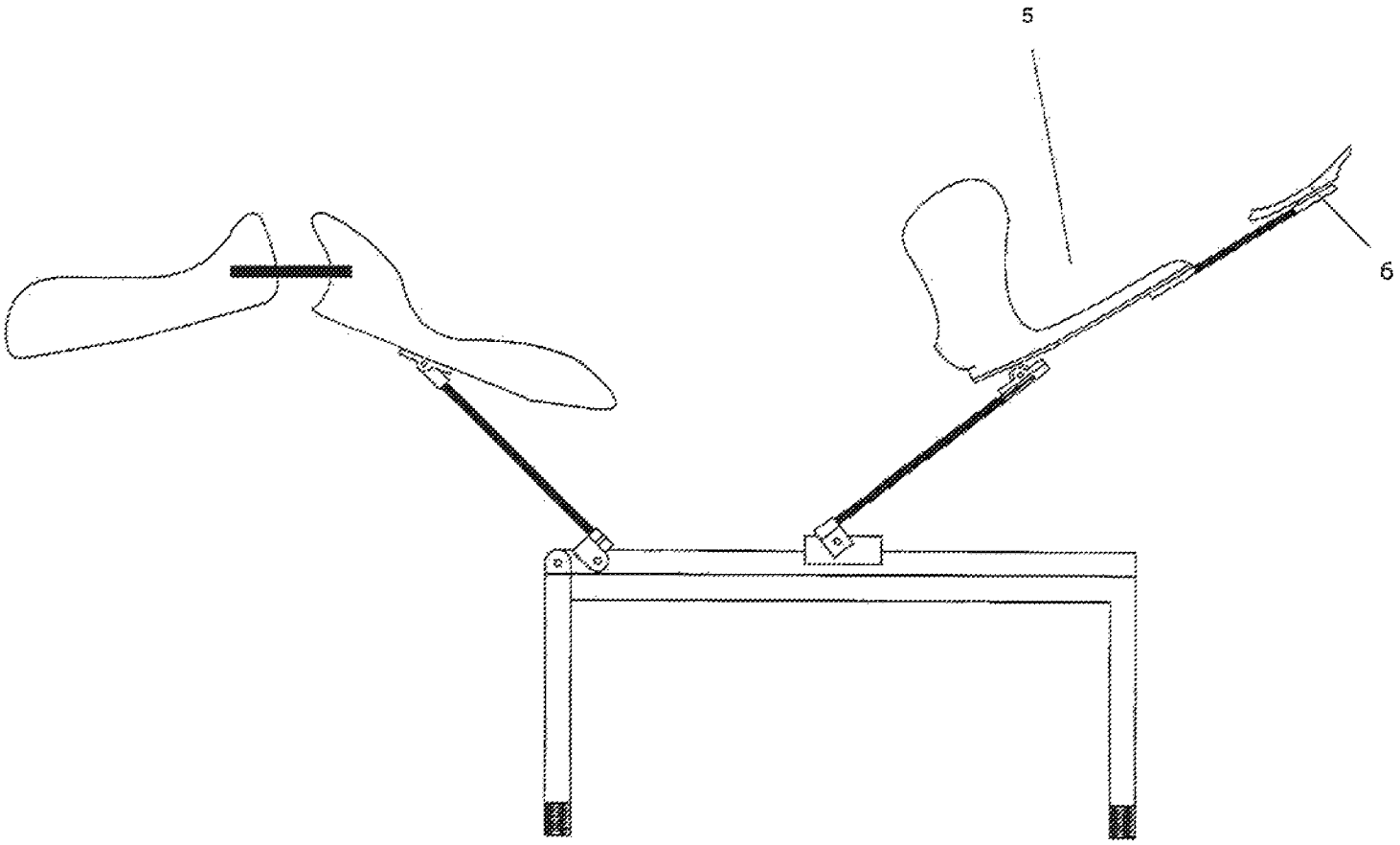
FIG. 5 a side view of the recliner device (1) as shown in FIG. 2 without the lower back support.

FIG. 5 shows a side view of the recliner device shown in FIG. 2 without lower back support. Most often the lower back support (5*a*) is not even necessary because the back support (5) typically receives and supports the center of gravity of the upper body of the lying person. In that case the lower back support (Sa) has more of a psychological function so that the lying person feels additionally stabilized because of the contact to the lower back support (5*a*).

Figure 6:
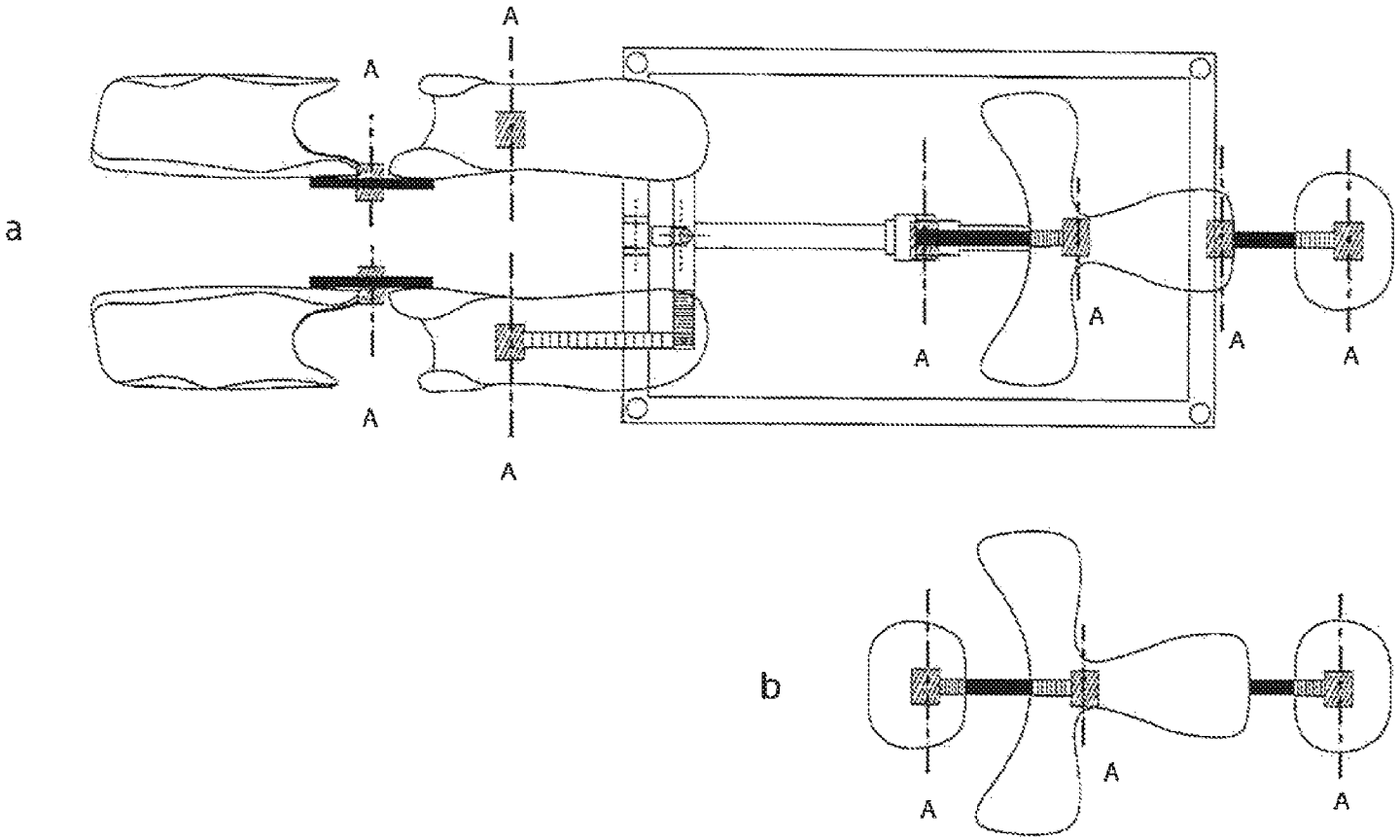
FIG. 6*a* shows a top view of the recliner device (1) shown in FIGS. 1 and 2 with a two-part back and head support.
FIG. 6*b* shows an alternative three-part back and head support with a lower back support.

FIG. 6 shows a top view of the recliner device (1) shown in FIGS. 1 and 2 with a two-part back and head support (a) and alternatively, a three-part back and head support with lower back support (b). The pivot bearings are shown hatched and the pivot axis are shown as dashed lines. Preferably the back support is constructed with side support on both sides and preferably the head-, back and/or the lower back support are each supplied with pivot bearing devices so that they allow for a limited deflection each so that the back and/or head of the person lying on the supports can move around the horizontal axis A. Moreover, additional or instead flexure elastic and/or torsion elastic levers, that allocate the individual supports of the back and head support to each other can impart further degrees of freedom to the spine of the person.

Figure 7:
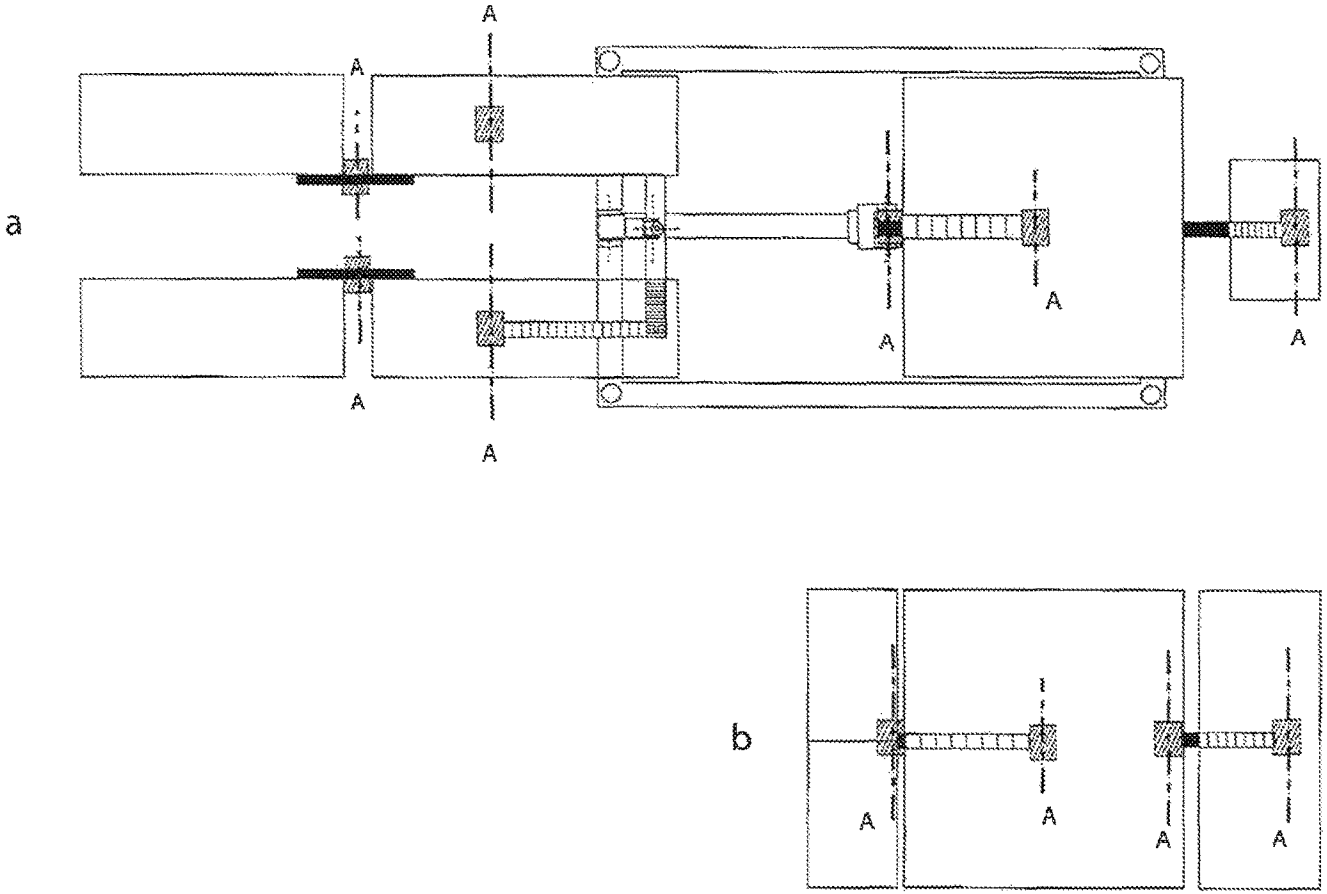
FIG. 7 a top view of a recliner device (1) of the invention with a rectangular, planar-shaped lower leg-, thigh-, back and head supports with lower back support (a); alternatively a three-part back and head support with lower back support is shown (b)
Figure 8:
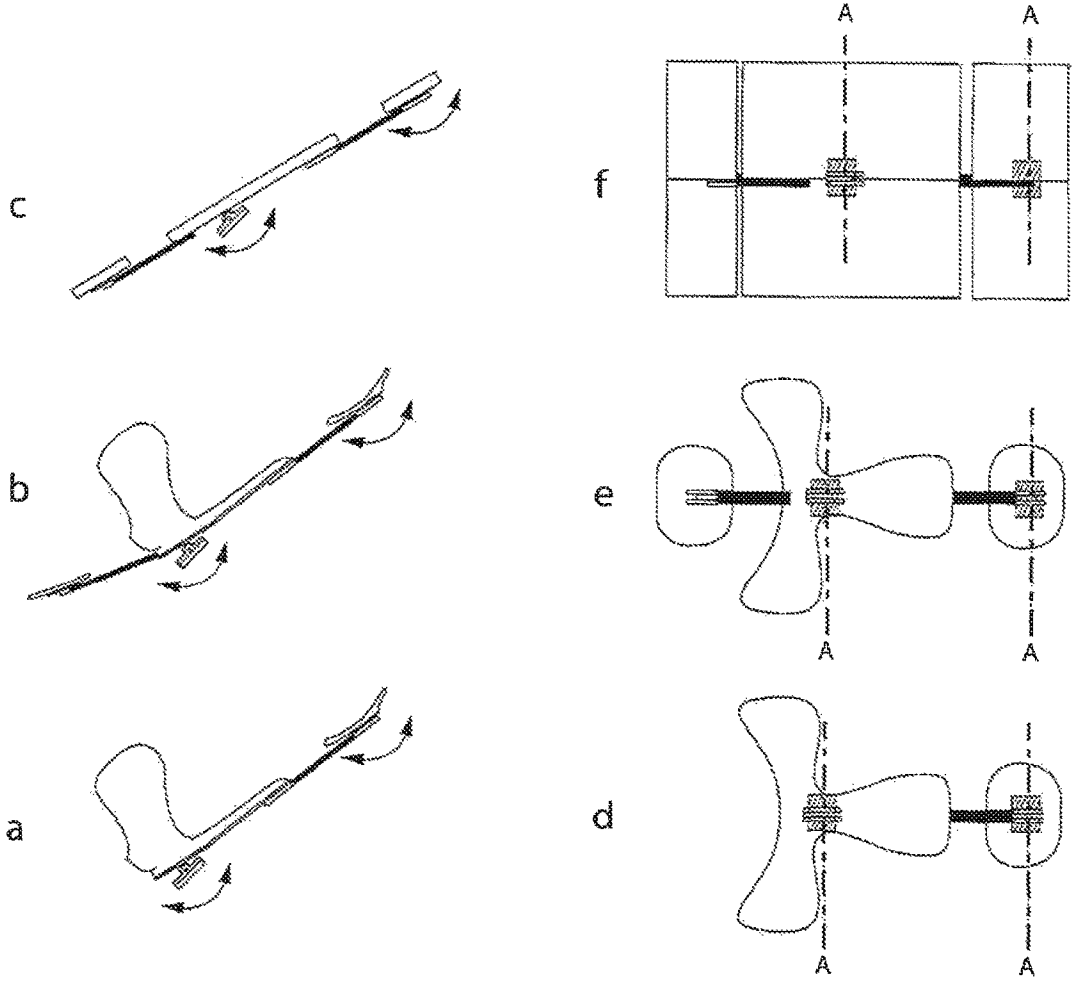
FIG. 8*a-f* side views and top views of inventive embodiments of the two- and three-part back and head supports.

FIG. 7 shows a top view of a recliner device of the present invention with rectangular, planar lower leg-, thigh-, back- and head supports (variant a). Alternatively, a three-part back and head support with a lower back support is shown (b). The pivot bearings are hatched and the pivot axis A is shown as dashed line. It is preferred that the respective supports are adapted to the anatomy of the received body parts. However, such defaults can considerably limit the use of the recliner device by bodily very different people or lead to pressure points with some groups of people. For this reason, it can be of advantage to construct one or more supports of the recliner device of the invention basically planar and possibly only well-padded. In a preferred embodiment singular, several or all supports can be designed variably adaptable to the anatomy of the lying person, for example by actuators, by pads that can be filled with air or liquids, etc.

FIGS. 8*a-f* show side views a-c) and top views (d-f) of embodiments of the present invention with two- and three-part back and head supports. In variant a, the head support is missing and the pivot bearing is located on top of the back support. The head support is of advantage for the present invention but not mandatory because it only improves the lying comfort, in particular for long term and relaxing lying, it is not absolutely necessary for effecting the "swimming" effect. However, lying down without a head support is little relaxing and makes it necessary that the lying person has to tension the neck and this has an effect on the posture of the back. Variant b is three-part with a lower back support. Most often one can dispense with the lower back support without loss of lying comfort; however, it contributes to the subjectively perceived lying comfort. Variant C is three-part and each of the three supports are designed rectangular. The top views d to f correspond to side views a to c.

REFERENCE NUMERALS

1 Recliner device
2 Foot
3 first thigh support
4 Second thigh support
5 Back and head support
5*a* Lower back support
6 Head support
7 Side support
8 First pivot bearing device
9 Second pivot bearing device
10 First lever arm
11 Second lever arm
12 First pivot bearing
13 Second pivot bearing
14 Pivot bearing device
15 Lever arm for back/head support
16 Second lower leg support
17 First lower leg support
18 Pivot bearing device for 17
19 Pivot bearing device for 16
20 Pivot bearing for connecting piece 26
21 Pivot bearing for base plate 25
22 Pivot bearing for back unit
23 Pivot bearing for base plate 25
24 Slide for pivot bearing 22
25 Base plate
26 Connecting piece to lever arm 10
27 Pivot bearing for leg unit
28 Damping for foot
29 Lever arm for head support 6
30 Lever arm for support 5*a*
31 Mount for leg unit

SUMMARY

The invention relates to a recliner device for supporting a lying person having a foot and arranged thereon (i) a first movably mounted thigh support for supporting the first thigh of the person, (ii) a movably mounted second thigh support for supporting the second thigh of the person, the second thigh support being independent of the first thigh support and being combinable with the first thigh support to form a complete support, and (iii) a movably mounted back and head support that is independent of the first and second thigh supports.

The invention claimed is:

1. A recliner device for supporting a lying person, the recliner device having a foot and arranged thereon:

a first movably mounted thigh support for supporting a first thigh of the person;

a movably mounted second thigh support for supporting a second thigh of the person, the second thigh support being independent of the first thigh support and being combinable with the first thigh support to form a complete support; and a movably mounted back and head support that is mounted independent of the first and second thigh supports for supporting at least the chest or the lower back of the person, wherein each thigh support is allocated to a thigh support pivot bearing device that can be pivoted around a horizontal axis at the respective thigh supports, for each thigh support, the thigh support pivot bearing device is allocated to a lever arm, and the lever arms of the thigh supports are directly coupled to a single pivotable connecting arm, the single pivotable connecting arm being coupled to the foot by a base plate, the back and head support is allocated to a back and head support pivot bearing device, different than the pivot bearing device for each thigh support, that can be pivoted around a horizontal axis at the back and head support, the back and head support pivot bearing device is allocated to the foot by a lever arm different than the lever arms of the thigh supports, and the pivot bearing devices are allocated to the thigh supports and the back and head support, respectively, in such a manner so as to be configured to enable the weight of the lying person to be received mainly at the person's thighs and back, and that the pivot bearing devices are configured to be freely pivoted by the lying person balancing in a lying state.

2. The recliner device according to claim 1, wherein both lever arms of the thigh supports are flexure elastic and can be bent by the lying person in a vertical direction.

3. The recliner device according to claim 1, wherein the lever arm of the back and head support is flexure elastic and can be bent by the lying person in a vertical direction.

4. The recliner device according to claim 1, wherein both lever arms of the thigh supports are torsion elastic and can be twisted by the lying person.

5. The recliner device according to claim 1, wherein the lever arm of the back and head support is torsion elastic and can be twisted by the lying person.

6. The recliner device according to claim 1, wherein both lever arms of the thigh supports and the lever arm of the back and head support are flexure elastic and torsion elastic.

7. The recliner device according to claim 1, wherein for each thigh support the pivot bearing device is allocated to the foot by means of the respective lever arm and a pivot bearing that can be pivoted around a vertical axis.

8. The recliner device according to claim 7, wherein the lever arms of the thigh supports are together allocated to the foot by means of the respective pivot bearing that can be pivoted around the respective vertical axis, wherein the pivot bearings of the lever arms of the thigh supports are allocated to the foot by an additional pivot bearing that can be pivoted around an additional vertical axis.

9. The recliner device according to claim 7, wherein at least one of the pivot bearing or pivot bearing devices is respectively a decelerating pivot bearing or a decelerating pivot bearing device.

10. The recliner device according to claim 1, wherein each thigh support is allocated to a lower leg support, respectively, either in a fixed manner or by means of an additional pivot bearing device that can be pivoted around the horizontal axis.

11. The recliner device according to claim 1, wherein the lever arms of the thigh supports or the lever arm of the back and head support are allocated to the foot by means of one or a plurality of additional pivot bearing devices that can pivot around a longitudinal axis of a base plate of the foot, wherein the lever arms or the lever arm are allocated to the foot by means of the one or the plurality of additional pivot bearing devices at the base plate that can be pivoted around the longitudinal axis.

12. The recliner device according to claim 11, wherein the one or the plurality of additional pivot bearing devices can be pivoted around the longitudinal axis by at least 2 degrees to 20 degrees.

13. The recliner device according to claim 12, wherein the one or the plurality of additional pivot bearing devices have a restoring force around the longitudinal axis or can be pivoted in a decelerating manner.

14. The recliner device according to claim 1, wherein at least one of the pivot bearing devices is a pivot bearing device that can be pivoted with a spring rigidity.

15. The recliner device according to claim 1, wherein at least one of the pivot bearing devices has a restoring force.

16. The recliner device according to claim 1, wherein an angle of at least one of the lever arms relative to a horizontal plane is capable of being between 5 degrees and 90 degrees.

17. The recliner device according to claim 1, wherein an angle of at least one of the lever arms is adjustable relative to a horizontal plane.

18. The recliner device according to claim 1, wherein a pivoting angle of at least one of the pivot bearing devices to at least one of the corresponding lever arms can be limited.

19. The recliner device according to claim 1, wherein a distance of the thigh supports to the back and head support is adjustable at the foot.

20. The recliner device according to claim 1, wherein the movably mounted back and head support comprises individual elements of a two-or multi-part arrangement, wherein the individual elements are selected from a one-piece back and head support, or a two-piece back and head support, or a three-piece head-support, upper-support, and lower back-support, wherein each of the individual elements of the two- or multi-part arrangement is connected rigidly, flexibly or movably to one another, and wherein the pivot bearing device of the back and head support is allocated to the back support or a lower back support that is allocated to the back support.

21. The recliner device according to claim 1, wherein a pivoting angle of the pivot bearing device around the horizontal axis of the back and head support is limited and the pivot bearing device of the back and head support has a restoring force.

22. The recliner device according to claim 1, wherein the foot or at least one of the lever arms is mounted in a damping or an elastic manner.

23. The recliner device according to claim 1, wherein at least one movable part of the recliner device is lockable or adjustable by machinery.

24. The recliner device according to claim 23, wherein the at least one movable part of the recliner device can be programmed to be locked or adjusted by machinery.

25. The recliner device according to claim 24, wherein the recliner device can be adjusted from a lying position into a sitting or standing position and vice versa.

* * * * *